United States Patent [19]

Maninger et al.

[11] Patent Number: 4,877,998

[45] Date of Patent: Oct. 31, 1989

[54] COLOR DISPLAY SYSTEM HAVING AN ELECTRON GUN WITH DUAL ELECTRODE MODULATION

[75] Inventors: Loren L. Maninger, Lancaster, Pa.; David A. New, Mercerville, N.J.; Carl L. Lundvall, II, Lancaster, Pa.

[73] Assignee: RCA Licensing Corp., Princeton, N.J.

[21] Appl. No.: 263,454

[22] Filed: Oct. 27, 1988

[51] Int. Cl.[4] ..... H01J 29/46; H01J 29/56

[52] U.S. Cl. ..... 315/15; 313/414; 313/449

[58] Field of Search ..... 315/382, 15; 313/414, 313/449

[56] References Cited

U.S. PATENT DOCUMENTS

| | | | |
|---|---|---|---|
| 3,952,224 | 4/1976 | Evans, Jr. | 313/414 |
| 3,984,723 | 10/1976 | Gross et al. | 313/412 |
| 4,234,814 | 11/1980 | Chen et al. | 313/412 |
| 4,319,163 | 3/1982 | Chen | 315/14 |
| 4,620,133 | 10/1986 | Morrell et al. | 315/15 |
| 4,731,563 | 3/1988 | Bloom et al. | 315/382 |
| 4,742,279 | 5/1988 | Gerritsen et al. | 315/382 |
| 4,764,704 | 8/1988 | New et al. | 313/414 |

OTHER PUBLICATIONS

Quadrupole Lens For Dynamic Focus and Astigmatism Control In An Elliptical Aperture Lens Gun, S. Shirai et al. SID Digest, 162 (1987).

Dynamic Astigmatism Control Quadra Potential Focus Gun for 21-in. Flat Square Color Display Tube, by T. Katsuma et al., SID Digest, 136 (1988).

*Primary Examiner*—Theodore M. Blum

*Attorney, Agent, or Firm*—Joseph S. Tripoli; Dennis H. Irlbeck; Vincent J. Coughlin, Jr.

[57] ABSTRACT

An improved color display system includes a cathode-ray tube and a magnetic deflection yoke positioned on the tube. The tube includes an envelope having an inline electron gun for generating and directing three inline beams along initially coplanar paths toward a screen on an interior surface portion of the envelope. The gun includes a plurality of spaced electrodes which comprise three lenses. The first lens includes a beam-forming region for providing substantially symmetrical beams to a second lens. The second lens includes a first modulation electrode for providing asymmetrically-shaped beams to a third, or main, lens. At least one and preferably two dynamic voltage signals are applied to the modulation electrode of the second lens. Another dynamic voltage signal is applied to a second modulation electrode of the third lens. The voltage signals are related to the deflection of the beams and improve the electron beam spot size at the periphery of the tube screen.

13 Claims, 11 Drawing Sheets

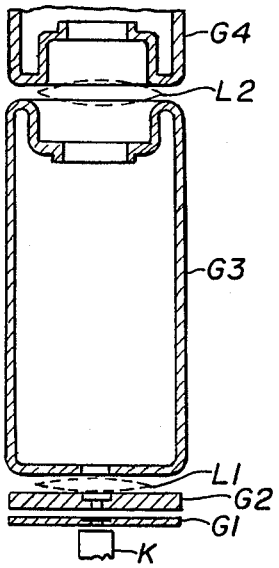
Fig. 2
PRIOR ART
Fig. 4a
PRIOR ART
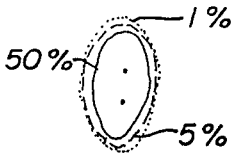
Fig. 4b
PRIOR ART
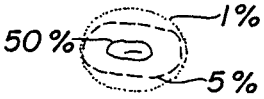
Fig. 4c
PRIOR ART
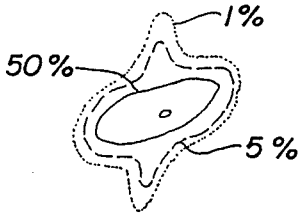

Fig. 8
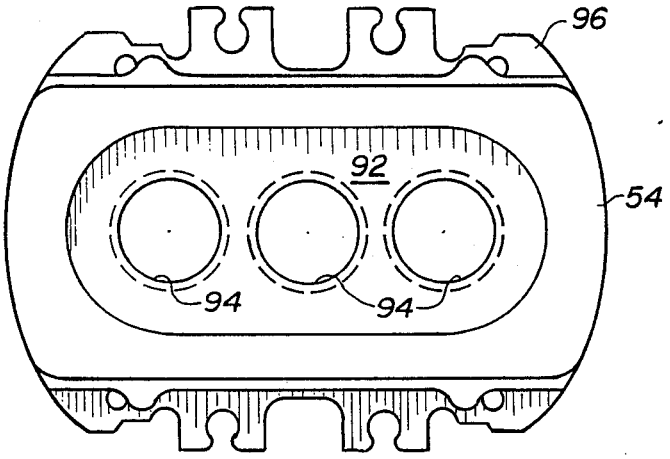
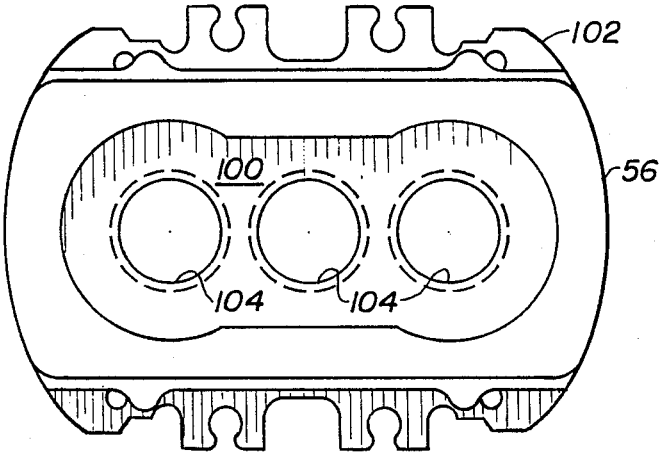
Fig. 9

COLOR DISPLAY SYSTEM HAVING AN ELECTRON GUN WITH DUAL ELECTRODE MODULATION

The present invention relates to a color display system including a cathode-ray tube (CRT), having an inline three beam electron gun, and particularly to such a system wherein the spot size of the electron beams is controlled by at least two different dynamic voltages applied to two of the electrodes of the electron gun.

BACKGROUND OF THE INVENTION

With recent utilization of large screen inline color CRT's for both CAD/CAM and entertainment applications, a reduced electron beam spot size over the entire screen is required for the high resolution requirements of such applications. The color display system includes the inline color CRT and a self-converging yoke, for providing magnetic fields which cause the beams to scan horizontally and vertically in a rectangular raster over the screen of the tube. Because of fringe fields, the self-converging yoke introduces into the tube strong astigmatism and deflection defocusing caused primarily by vertical overfocusing and, secondarily, by horizontal underfocusing of the beams during deflection.

To compensate, it has been the practice to introduce an astigmatism into the beam-forming region of the electron gun to produce a defocusing of the vertical rays and an enhanced focusing of the horizontal rays. Such astigmatic beam-forming regions have been constructed by means of G1 control grids or G2 screen grids having slot-shaped apertures. These slot-shaped apertures produce non-axially-symmetric fields with quadrupolar components which act differently upon rays in the vertical and horizontal planes. Such slot-shaped apertures are shown in U.S. Pat. No. 4,234,814, issued to Chen et al. on Nov. 18, 1980. These constructions are static; the quadrupole field produces compensatory astigmatism even when the beams are undeflected and experiencing no yoke astigmatism.

To provide improved dynamic correction, U.S. Pat. No. 4,319,163, issued to Chen on March 9, 1982, introduces an extra upstream screen grid, G2*a*, with horizontally slotted apertures, and with a variable or modulated voltage applied to it. The downstream screen grid, G2*b*, has round apertures and is at a fixed voltage. The variable voltage on G2*a* varies the strength of the quadrupole field, so that the astigmatism produced is proportional to the scanned off-axis position.

Although effective, use of astigmatic beam-forming regions has several disadvantages. First, beam-forming regions have a high sensitivity to construction tolerances because of the small dimensions involved. Second, the effective length or thickness of the G2 grid must be changed from the optimum value it has in the absence of slotted apertures. Third, beam current may vary when a variable voltage is applied to a beam-forming region grid. Fourth, the effectiveness of the quadrupole field varies with the position of the beam crossover and, thus, with beam current.

U.S. Pat. No. 4,731,563 issued to Bloom et al. on March 15, 1988 discloses an astigmatism correction for an electron gun which is not subject to the enumerated disadvantages. The gun includes beam-forming region electrodes, main focusing lens electrodes, and two interdigitated electrodes for forming a multipole lens between the beam-forming region and the main focusing lens in each of the electron beam paths. Each multipole lens is oriented to provide a correction to an associated electron beam to at least partially compensate for the effect of the astigmatic magnetic deflection field on that beam. A first multipole lens electrode is located between the beam-forming region electrodes and the main focusing lens electrodes. A second multipole electrode is connected to a main focusing lens electrode and located between the first multipole lens electrode and the main focusing lens, adjacent to the first multipole lens electrode. Means are included for applying a fixed focus voltage to the second multipole lens electrode and a dynamic voltage signal, related to the deflection of the electron beams to the first multipole lens electrode. Each multipole lens is located sufficiently close to the main focusing lens to cause the strength of the main focusing lens to vary as a function of voltage variation of the dynamic voltage signal. The dynamic voltage signal modulates the first multipole lens electrode at the horizontal scan rate to correct the distortion of the electron beams at the 3:00 and 9:00 o'clock (hereinafter the 3D and 9D) screen locations with a single waveform. However, because of the penetration of the fringe fields into the electron gun, the beams are caused to pass off-axis through a stronger part of the main focusing lens. The off-axis paths of the beams and the vertical overfocusing action caused by the vertical deflection windings of the self-converging yoke require a higher vertical focus voltage at the top of the screen than at the center of the screen, and dynamic correction of this focus voltage difference must be achieved at the vertical scan rate. This can be achieved using the interdigital structure within the main focusing lens; however, because of the low vertical rate frequency (60 Hz), it is difficult to economically capacitively couple the required waveform into the focus supply without degrading the tracking characteristics of the focus supply with respect to the anode supply U.S. Pat. No. 4,764,704 issued to New et al. on Aug. 16, 1988 utilizes the dynamically modulated multipole lens of U.S. Pat. No. 4,731,563 in combination with an additional lens located between the beam-forming region of the electron gun and the multipole lens. The additional lens provides a static correction and refraction of the electron beams emerging off axis from the lens of the beam-forming region and asymmetrically focuses the beams to provide asymmetrically-shaped beams to the main focus lens. A drawback of the additional lens is that the rectangularly-shaped apertures that are utilized to provide static correction to the beams are difficult to align accurately on the cylindrical mount pins used during electron gun fabrication.

T. Katsuma et al. in an article entitled, DYNAMIC ASTIGMATISM CONTROL QUADRA POTENTIAL FOCUS GUN FOR 21-IN. FLAT SQUARE COLOR DISPLAY TUBE, SID DIGEST, 136 (1988), describe a Quadra Potential Focus gun having six electrodes with the fourth (G4) electrode comprising three discrete element G41, G42, and G43. A dynamic voltage with a parabolic wave form is applied to the G2 electrode and to the G41 and G43 elements of the G4 electrode. The G42 element has vertically oriented oval apertures which in conjunction with the horizontal blades located above and below the round apertures of the G41 and G43 elements, facing the G42 element, form a quadrupole lens that provides adequate compensation for astigmatism and deflection defocusing. A drawback of the described gun is that the number of parts has been increased, adding to the cost of the gun, and the oval apertures in the G42 element pose the same difficulty in alignment as the rectangular apertures of U.S. Pat. No. 4,764,704.

A variation of the gun of Katsuma et al. is described in an article entitled, QUADRUPOLE LENS FOR DYNAMIC FOCUS AND ASTIGMATISM CONTROL IN AN ELLIPTICAL APERTURE LENS GUN, S. Shirai et al., SID DIGEST, 162 (1987). The quadrupole lens of the Shirai et al. gun is also formed by a three element G4 electrode. The quadrupole lens is formed by rotationally asymmetrical through-holes in the G42 element and horizontal slots around the circular apertures of the G41 and G43 elements of the G4 electrode. A dynamic voltage is applied to the G41 and G43 elements. A disclosed drawback of the gun is that the astigmatism correction ability of the quadrupole lens is limited by the aberration of the main lens.

SUMMARY OF THE INVENTION

The improved color display system, according to the present invention, includes a cathode-ray tube and a magnetic deflection yoke positioned on the tube. The tube includes an envelope having an inline electron gun for generating and directing three inline beams along initially coplanar paths toward a screen on an interior surface portion of the envelope. The gun includes a plurality of spaced electrodes which comprise three lenses. The first lens has a beam-forming region for providing substantially symmetrical beams to a second lens. The second lens includes asymmetric beam-focusing means for providing asymmetrically-shaped beams to a third lens. Means are provided for applying at least one dynamic voltage signal to a first modulation electrode of the second lens. Means also are provided for simultaneously applying another dynamic voltage signal to a second modulation electrode of the third lens. The first and second signals are related to the deflection of the electron beams and improve the electron beam spot size at the periphery of the screen. A different additional dynamic voltage signal also related to the deflection of the beams may be applied to the first modulation electrode of the second lens to further improve the performance of the tube.

BRIEF DESCRIPTION OF THE DRAWINGS

FIG. 2 is a schematic sectional view showing an overall construction of a conventional bipotential four-grid electron gun.

FIG. 4*a* shows the electron beam current density contour at the center of the screen for the electron gun of FIG. 2; FIG. 4*b* shows the electron beam current density contour within the main lens of the electron gun of FIG. 2 and FIG. 4*c* shows the current density contour for the electron beam of the electron gun of FIG. 2 deflected to the upper right hand corner of the screen in FIG. 3.

FIGS. 7, 8, 9 and 10 are sectional views of the electron gun shown in FIG. 5, taken along lines 7—7, 8—8, 9—9 and 10—10.

DETAILED DESCRIPTION OF THE PREFERRED EMBODIMENT

Figure 1:
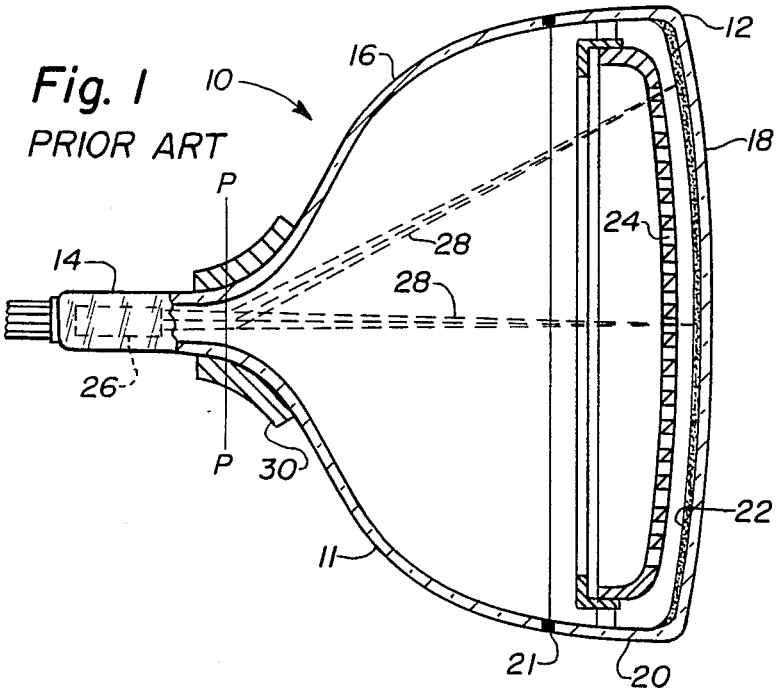
Fig. 1 PRIOR ART
FIG. 1 is a plan view partially in axial section of a conventional color cathode ray tube.

FIG. 1 shows a conventional rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 by a frit seal 21. A mosaic three-color phosphor screen 22 is located on the interior surface of the faceplate 18. The screen preferably is a line screen with the phosphor lines extending substantially perpendicular to the high frequency raster line scan of the tube (normal to the plane of the FIG. 1). Alternatively, the screen could be a dot screen. A multi-apertured color selection electrode or shadow mask 24 is removably mounted, by conventional means, in predetermined spaced relation to the screen 22. An inline electron gun 26, shown schematically by dashed lines in FIG. 1, is centrally mounted within the neck 14 to generate and direct three electron beams 28 along initially coplanar beam paths through the mask 24 and toward the screen 22. One type of electron gun that is conventional is a four grid bipotential electron gun such as that shown in FIG. 2 and described in U.S. Pat. No. 4,620,133, issued to Morrell et al. on October 28, 1986.

Figure 3:
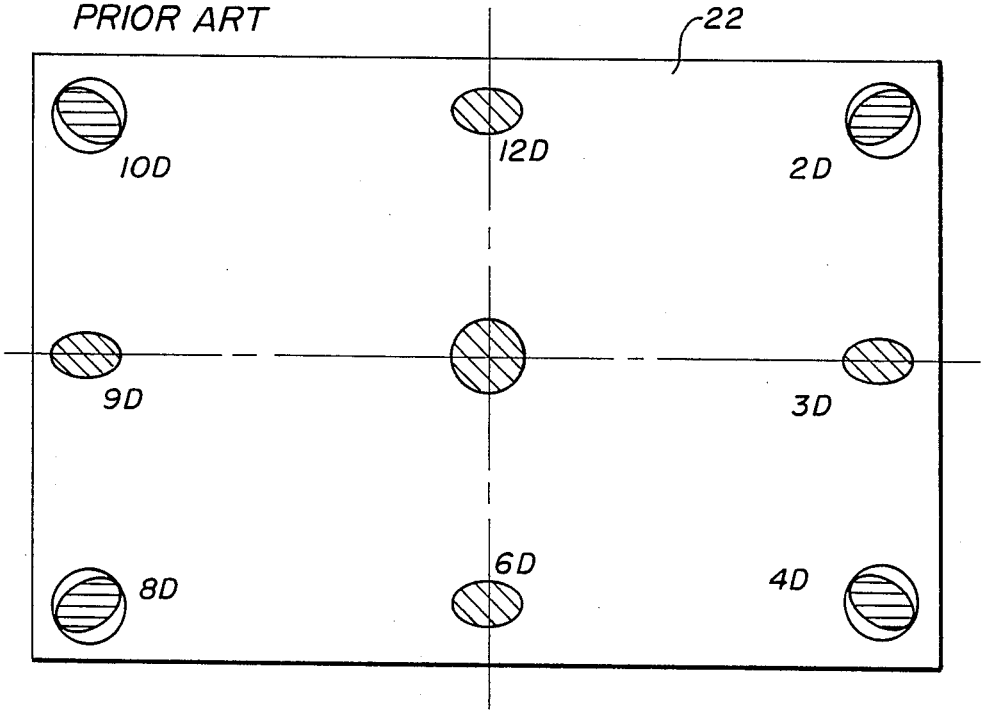
Fig. 3 PRIOR ART
FIG. 3 is a representation showing the shapes of electron beam spots on the screen of a conventional color cathode-ray tube.

The tube of FIG. 1 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially from the yoke 30 into the region of the gun 26. For simplicity, the actual curvature of the deflected beam paths in the deflection zone is not shown in FIG. 1. The yoke 30 provides an inhomogeneous magnetic field that has a strong pin cushion-like vertical deflection magnetic field and a strong barrel-like horizontal deflection magnetic field, to converge the electron beams at the peripheral part of the screen 22. When the electron beams pass through such an inhomogeneous magnetic field, the beams are subject to distortions and defocusing. As a result, at the peripheral portions of the screen 22, the shape of the electron beam spot is greatly distorted. FIG. 3 represents an electron beam spot for a single beam which is circular at the center of the screen and undergoes various types of distortions at the periphery of the screen 22. As shown in FIG. 3, the beam spot becomes horizontally elongated when deflected along the horizontal axis. The beam spot at the four corners of the screen comprises a combination of horizontally elongated portions and vertically elongated portions that form elliptically-shaped spots with halo-shaped elongations thereabout. The resolution is degraded as the electron beam is deflected, and the non-uniform focusing, which cannot be neglected, presents a problem which must be addressed.

The above-cited U.S. Pat. No. 4,620,133, to Morrell et al., addresses the beam focus problem by providing a color imaging display system that includes a deflection yoke and an electron gun that has both a beam forming region, comprising a first grid, G1, a second grid, G2, a third grid, G3, and a main focusing lens, G3-G4, which works in conjunction with the deflection yoke and the beam forming region to provide a beam spot at the screen 22. FIG. 4*a* herein shows an electron beam current density contour, at the center of the screen 22, for an electron beam produced by the beam forming region and the main lens of the electron gun shown in FIG. 2. The beam current of the electron gun is 4 milliamperes. The electron beam current density contour of FIG. 4*a* comprises a relatively large center portion, having a substantially constant beam current of about 50% of the average beam current, and peripheral portions, where the beam current drops to about 5% of the average beam current and finally to about 1% of the average beam current. The beam is elliptically-shaped along the vertical axis to reduce the overfocusing action of the yoke when the beam is deflected. FIG. 4*b* shows the beam current density contour within the main lens, L2, that is between the G3 and G4 electrodes of FIG. 2. The electron beam at this location is horizontally elongated; however, the 50% beam current density portion is contained within the small elliptical center section of the beam which is circumscribed by the larger elliptical portions which represent the 5% and 1% beam current density profiles. FIG. 4*c* shows the electron beam current density contour of the electron beam deflected into the upper right hand corner of the screen. Same haloing occurs above and below the central portion of the beam. The beam spots produced on the screen by the conventional bipotential electron gun are unacceptable for large screen television sets and CAD/CAM applications.

Figure 5:
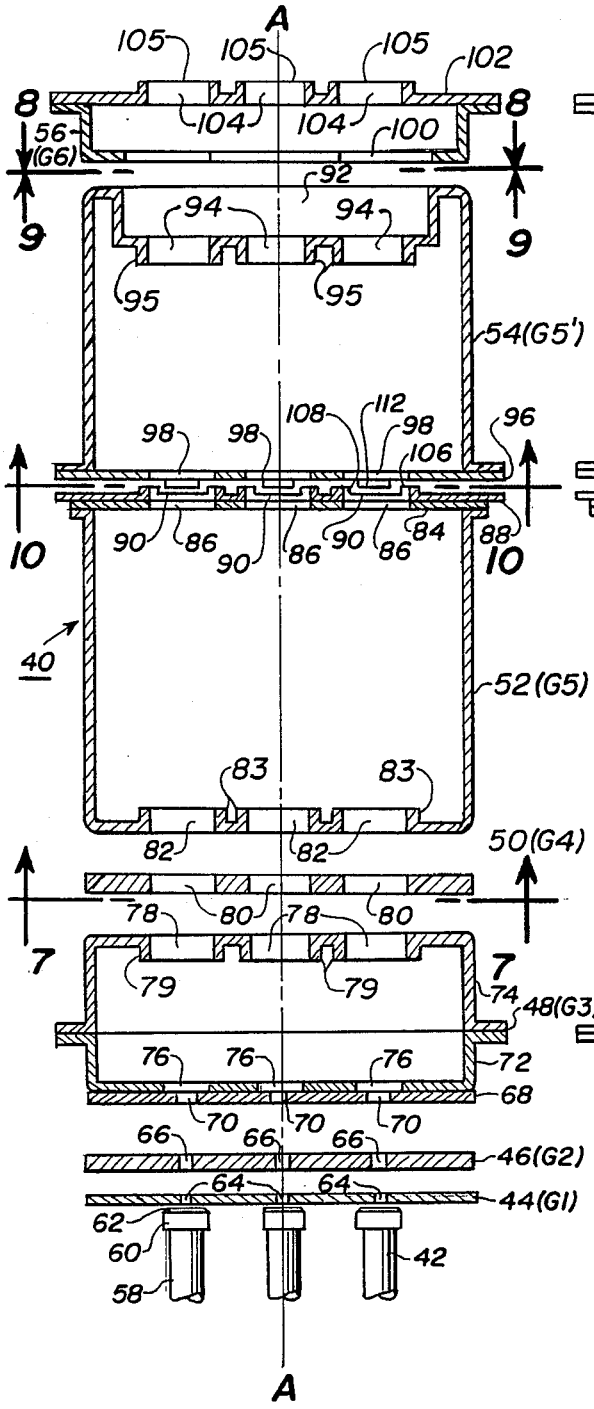
FIGS. 5 and 6 are axial front and side views, respectively, of an electron gun according to the present invention.
Figure 6:
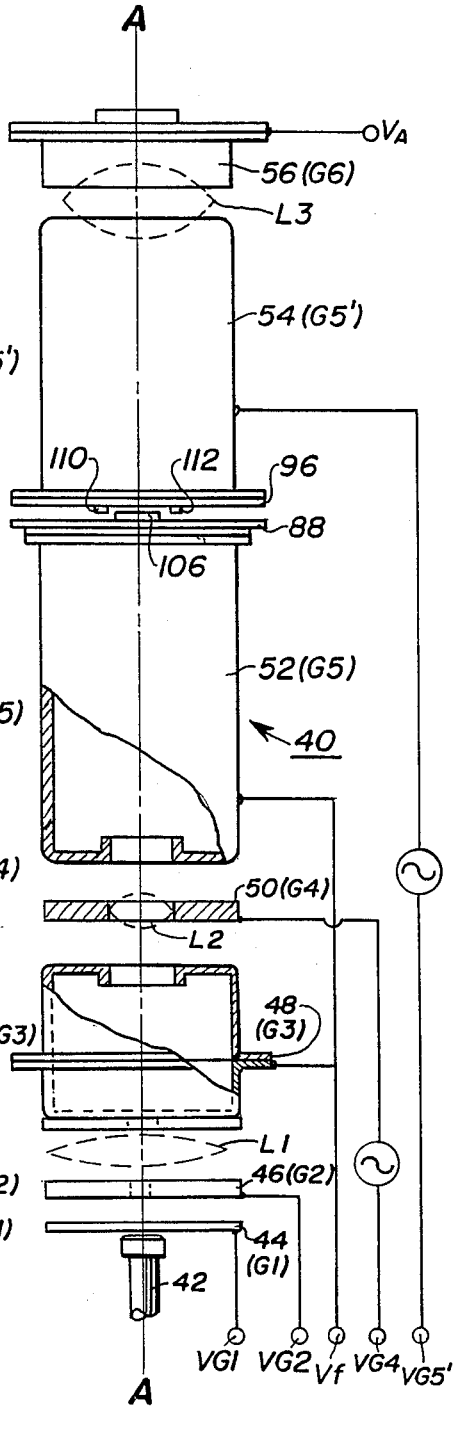

The details of an electron gun 40, according to the present invention, are shown in FIGS. 5 and 6. the gun 40 comprises three equally spaced coplanar cathodes 42 (one for each beam), a control grid 44 (G1), a screen grid 46 (G2), a third electrode 48 (G3), a fourth electrode 50 (G4), a fifth electrode 52 (G5), the G5 electrode including a portion G5′ identified as element 54, and a sixth electrode 56 (G6). The electrodes are spaced in the order named from the cathodes and are attached to a pair of glass support rods (not shown).

The cathodes 42, the G1 electrode 44, the G2 electrode 46 and a portion of the G3 electrode 48 facing the G2 electrode 46 comprise a beam forming region of the electron gun 40. Another portion of the G3 electrode 48, the G4 electrode 50 and the G5 electrode 52 comprise a first asymmetric lens. The portion 54 of the G5′ electrode and the G6 electrode 56 comprise a main focusing (or second asymmetric) lens.

Each cathode 42 comprises a cathode sleeve 58 closed at its forward end by a cap 60 having an end coating 62 of an electron emissive material thereon, as is known in the art. Each cathode 42 is indirectly heated by a heater coil (not shown) positioned within the sleeve 58.

The G1 and G2 electrodes, 44 and 46, are two closely spaced substantially flat plates each having three pairs of inline apertures 64 and 66, respectively, therethrough. The apertures 64 and 66 are centered with the cathode coating 62, to initiate three equally-spaced coplanar electron beams 28 (as shown in FIG. 1) directed towards the screen 22. Preferably, the initial electron beam paths are substantially parallel, with the middle path coinciding with the central axis A—A of the electron gun.

The G3 electrode 48 includes a substantially flat outer plate portion 68 having three inline apertures 70 therethrough, which are aligned with the apertures 66 and 64 in the G2 and G1 electrodes 46 and 44, respectively. The G3 electrode 48 also includes a pair of cup-shaped first and second portions 72 and 74, respectively, which are joined together at their open ends. The first portion 72 has three inline apertures 76 formed through the bottom of the cup, which are aligned with the apertures 70 in the plate 68. The second portion 74 of the G3 electrode has three apertures 78 formed through its bottom, which are aligned with the apertures 76 in the first portion 72. Extrusions 79 surround the apertures 78. Alternatively, the plate portion 68 with its inline apertures 70 may be formed as an integral part of the first portion 72.

The novel G4 modulation electrode 50 comprises a substantially flat plate having three rotationally asymmetrical inline apertures 80 formed therethrough, which are aligned with the apertures 78 in the G3 electrode. The shape of the apertures 80 is shown in FIG. 7.

Figure 7:
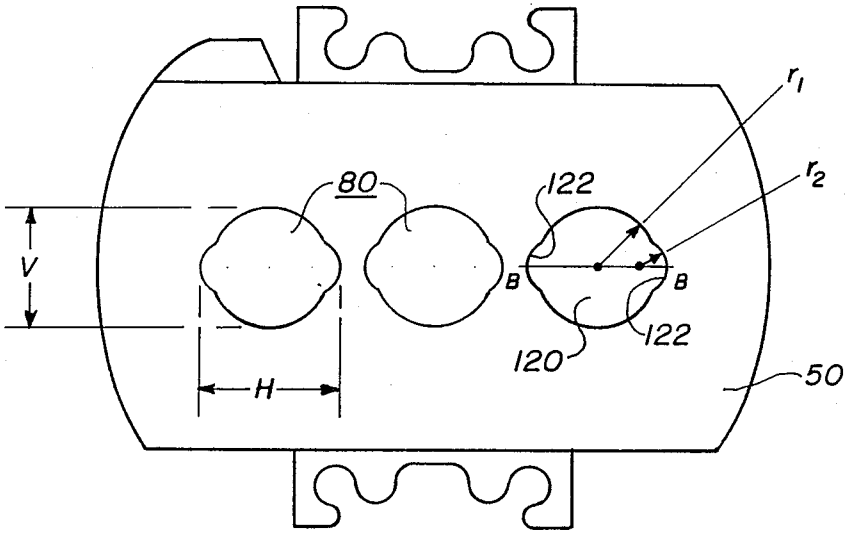

As shown in Fig. 7, the rotationally asymmetrical apertures 80 are elongated in the horizontal direction, i.e., in the direction of the inline apertures. each of the apertures 80 includes a substantially circular center portion comprising a primary opening 120 having a radius, $r_1$, of 0.079 inch (2.007 mm) and a pair of oppositely disposed arcuate portions 122 formed by secondary openings located on each side of the primary opening. The secondary openings partially overlie the primary opening 120 and each has a radius, $r_2$, of 0.020 inch (0.511 mm) and is located on the horizontal axis B—B a distance of 0.067 inch (2.301 mm) from the center of the opening 120, so that the overall horizontal dimension, H, of the aperture 80 is 0.174 inch (4.420 mm). The secondary openings 122 are blended smoothly into the primary openings 120. The maximum vertical dimension, V, of the aperture 80 is 0.158 inch (4,013 mm) and is equal to the diameter of the primary opening 120. The circular primary opening facilitate assembly of the electron gun components on cylindrical mount pins. The rotationally asymmetrical apertures 80 provide a quadrupole focusing effect on the beams passing therethrough which effect is enhanced by the application of a dynamic voltage thereto which varies with the deflection of the electron beams. The application of dynamic voltages to a relatively low voltage element of an electron gun is disclosed in U.S. Pat. No. 4,319,163 which is incorporated by reference herein for its teaching of providing suitable dynamic signals.

The G5 electrode 52 is a deep-drawn cup-shaped member having three apertures 82, surrounded by extrusions 83, formed in the bottom end thereof. A substantially flat plate member 84 having three apertures 86, aligned with the apertures 82, is attached to and closes the open end of the G5 electrode 52. A first plate portion 88, having a plurality of openings 90 therein, is attached to the opposite surface of the plate member 84.

The G5' electrode 54 comprises a deep-drawn cup-shaped member having a recess 92, formed in the bottom end with three inline apertures 94 formed in the bottom surface thereof. Extrusions 95 surround the apertures 94. The opposite open end of the G5' electrode 54 is closed by a second plate portion 96 having three openings 98 formed therethrough which are aligned and cooperate with the openings 90 in the first plate portion 88 in a manner described below.

The G6 electrode 56 is a cup-shaped deep-drawn member having a large opening 100 at one end, through which all three electron beams pass, and an open end, which is attached to and closed by a plate member 102 that has three apertures 104 therethrough which are aligned with the apertures 94 in the G5' electrode 54. Extrusions 105 surround the apertures 104.

The shape of the recess 92 in the G5' electrode 54 is shown in FIG. 8. The recess 92 has a uniform vertical width at each of the electron beam paths, with rounded ends. Such a shape has been referred to as the "racetrack" shape.

The shape of the large aperture 100 in the G6 electrode 56 is shown in FIG. 9. The aperture 100 is vertically higher at the side electron beam paths than it is at the center beam path. Such a shape has been referred to as the "dogbone" or "barbell" shape.

Figure 10:
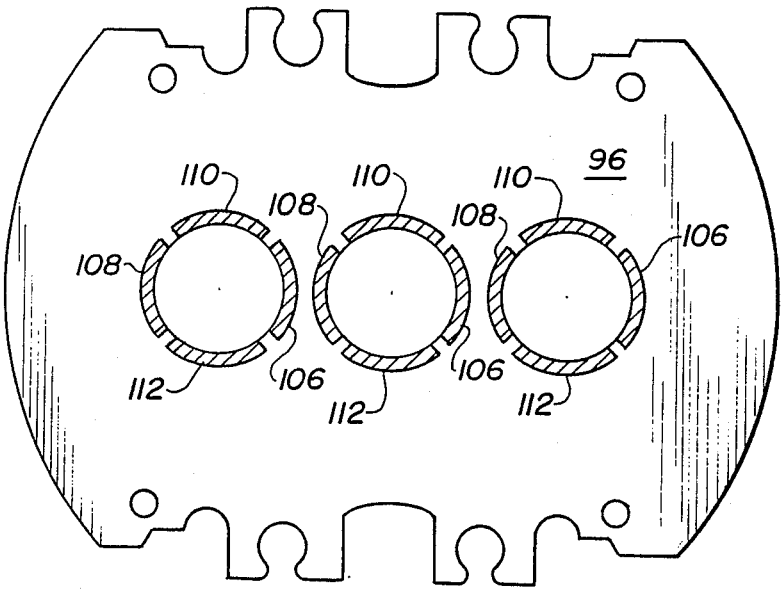

The first plate portion 88 of the G5 electrode 52 faces the second plate portion 96 of the G5' electrode 54. The apertures 90 in the first plate portion 88 of the G5 electrode 52 have extrusions, extending from the plate portion, that have been divided into two segments 106 and 108 for each aperture. The apertures 98 in the second plate portion 96 of the G5' electrode 54 also have extrusions, extending from the plate portion 96, that have been divided into two segments 110 and 112 for each aperture. As shown in FIG. 10, the segments 106 and 108 are interleaved with the segments 110 and 112. These segments are used to create multipole (e.g. quadrupole) lenses in the paths of each electron beam when different potentials are applied to the G5 and G5' electrodes 52 and 54, respectively. By proper application of a dynamic voltage signal to the G5' electrode 54, it is possible to use the quadrupole lenses established by the segments 106, 108, 110 and 112 to provide an astigmatic correction to the electron beams, to compensate for astigmatisms occurring in either the electron gun or in the deflection yoke. Such a quadrupole lens structure is described in U.S. Pat. No. 4,731,563 issued to S. Bloom et al. on March 15, 1988.

Specific dimensions of a computer-modeled electron gun for use in a 27V110 tube are presented in the TABLE.

TABLE

| | Inches | mm |
|---|---|---|
| K-G1 spacing | 0.003 | 0.08 |
| Thickness of G1 electrode 44 | 0.0025 | 0.06 |
| Thickness of G2 electrode 46 | 0.024 | 0.61 |
| G1 and G2 aperture diameter | 0.025 | 0.64 |
| G1 to G2 spacing | 0.010 | 0.25 |
| G2 to G3 spacing | 0.030 | 0.76 |
| Thickness of G3 plate portion 68 | 0.010 | 0.25 |
| G3 aperture diameter | 0.040 | 1.02 |
| Length of G3 electrode | 0.200 | 5.08 |
| Thickness of G4 electrode 50 | 0.035 | 0.89 |
| G4 electrode aperture size | 0.158V × 0.174H | 4.01V × 4.42H |
| G3 to G4 spacing | 0.050 | 1.27 |
| Overall length of G5 and G5' electrodes 52 and 54 | 0.890 | 22.61 |
| G4 to G5 spacing | 0.050 | 1.27 |
| Spacing beteeen plate portions 88 and 96 | 0.040 | 1.02 |
| Length of recess 92 | 0.715 | 18.16 |
| Vertical height of recess 92 | 0.315 | 8.00 |
| Depth of recess 92 | 0.115 | 2.92 |
| Length of G6 electrode | 0.130 | 3.30 |
| G5 to G6 spacing | 0.050 | 1.27 |
| Diameter of apertures 78, 82, 90 94, 98 and 104 | 0.160 | 4.06 |
| Center-to-center aperture spacing | 0.200 | 5.08 |
| Length of aperture 100 | 0.698 | 17.73 |
| Vertical height of aperture 100 at center beam | 0.267 | 6.78 |
| Vertical height of aperture 100 at outer beams | 0.280 | 7.11 |
| Depth of aperture 100 | 0.115 | 2.92 |
| Length of G3 extrusions 79 | 0.035 | 0.89 |
| Length of G5 extrusions 83 | 0.029 | 0.74 |
| Length of G5' extrusions 95 | 0.034 | 0.86 |
| Length of G6 extrusions 105 | 0.045 | 1.14 |

In the embodiment presented in the TABLE, the electron gun 40 is electrically connected as shown in FIG. 6. Typcially, the cathode operates at about 150 V, the G1 electrode is at ground potential, the G2 electrode operates within the range of about 300V to 1000 V, the G3 and G5 electrodes are electrically interconnected and operate at about 7 kV, and the G6 electrode operates at an anode potential of about 25 kV. At least one dynamic voltage signal is applied to the G4 electrode and another dynamic voltage signal is applied to the G5' electrode.

Figure 11:
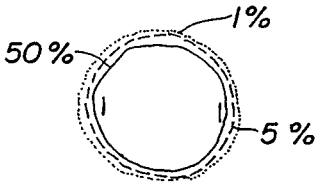
FIG. 11 shows the electron beam current density contour from the beam forming region (first lens) of the present electron gun.

In the present electron gun 40, the first lens, L1, (FIG. 6) comprising the G1 electrode 44, the G2 electrode 46 and the adjacent portion of the G3 electrode 48, provides a symmetrically-shaped high quality electron beam rather than an asymmetrically-shaped electron beam into the second lens, L2. The beam current density contour of one of the beams of L1 is shown in FIG. 11. It can be seen that the present beam forming region does not introduce any appreciable asymmetry into the electron beam.

Figure 12:
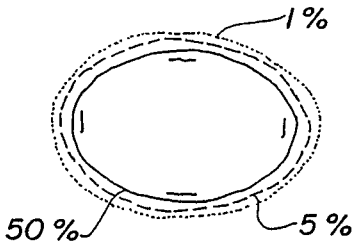
FIG. 12 shows the electron beam current density contour within the main lens produced by the second lens of the present electron gun.

The second lens, L2, comprising the G4 modulation electrode 50 and the adjacent portions of the G3 electrode 48 and the G5 electrode 52, constitutes an asymmetric lens which provides a horizontally-elongated electron beam which, within the third or main focus lens, L3, has the beam spot contour shown in FIG. 12. The substantially oval shape of the electron beam is produced by the combination of, the rotationally asymmetrical apertures 80 formed through the G4 electrode 50 and the dynamic voltage applied thereto.

The main, or third, focus lens, L3, formed between the G5' electrode 54 and the G6 electrode 56 also is a low aberration lens, which is optimized, as described below, for zero astigmatism at the center of the screen with the main lens modulation electrode 54 and the focus electrode 52 at the same potential (about 7 kV) while the G4 electrode 50 is at the same potential (about 350 V) as on the G2 electrode 46.

In the present electron gun 40,the G4 modulation electrode 50 is effective for both horizontal rate modulation (15.75 KHz) along the major tube (inline) axis from the 3D to the 9D screen locations, and for the vertical rate modulation (60 Hz) along the minor tube axis (normal to the inline axis) from the 6D to the 12D screen locations. However, because the G4 electrode is too close to the electron beam crossover position at high currents, it cannot totally compensate for deflection defocusing in the 2D and 10D tube corners (and also by symmetry in the 4D and 8D corners). Because of the difficulties of capacitively coupling at the vertical scan rate in the high voltage focus supply (7 kV), and because of the ineffectiveness of horizontal rate modulation at the tube corners (2D-10D and 4D-8D) using only the low voltage G4 electrode 50, the present invention utilizes dual modulation electrodes. The horizontal rate modulation is accomplished by superimposing a substantially parabolic voltage signal which increases with deflection angle, onto the focus supply voltage which is coupled to the G5' electrode 54. Vertical rate modulation is achieved by applying a different parabolic voltage signal, which also increases with deflection angle, onto the low focus voltage applied to the G4 electrode 50.

Figure 13:
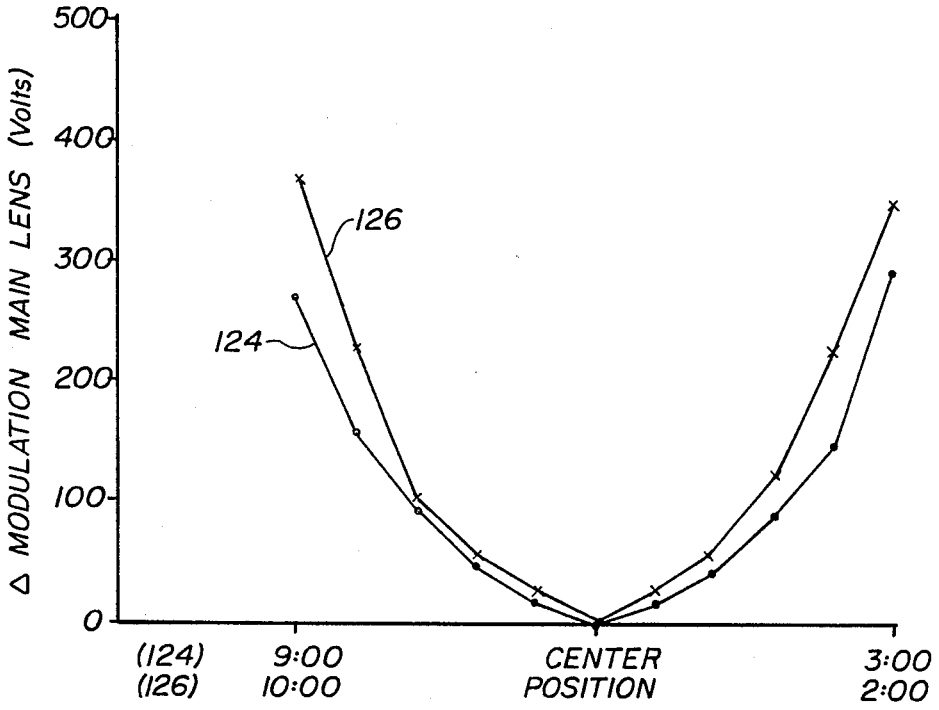
FIG. 13 shows two curves which represent the horizontal rate modulation voltage that must be superimposed on the 7 kV focus voltage applied to the G5′ electrode to focus the vertical component of the electron beams along the major tube axis, and along the top of the screen, respectively.

FIG. 13 shows a first curve 124 that depicts the horizontal rate modulation voltage signal, with respect to the (screen center) focus voltage (7 kV) that is required on the G5' electrode 54 to focus the electron beams along the major tube axis from 3D to 9D. Curve 126 shows the higher horizontal rate modulation voltage necessary on the G5' electrode 54 to focus the electron beams across the top (or bottom) of the screen from 2D to 10D (or 4D to 8D) when a suitable vertical rate modulation voltage signal is applied to the G4 electrode 50 for correcting the electron beam focus along the minor axis of the tube from 6D to 12D. The vertical rate modulation voltage signal curve 128 is shown in FIG. 14.

Figure 14:
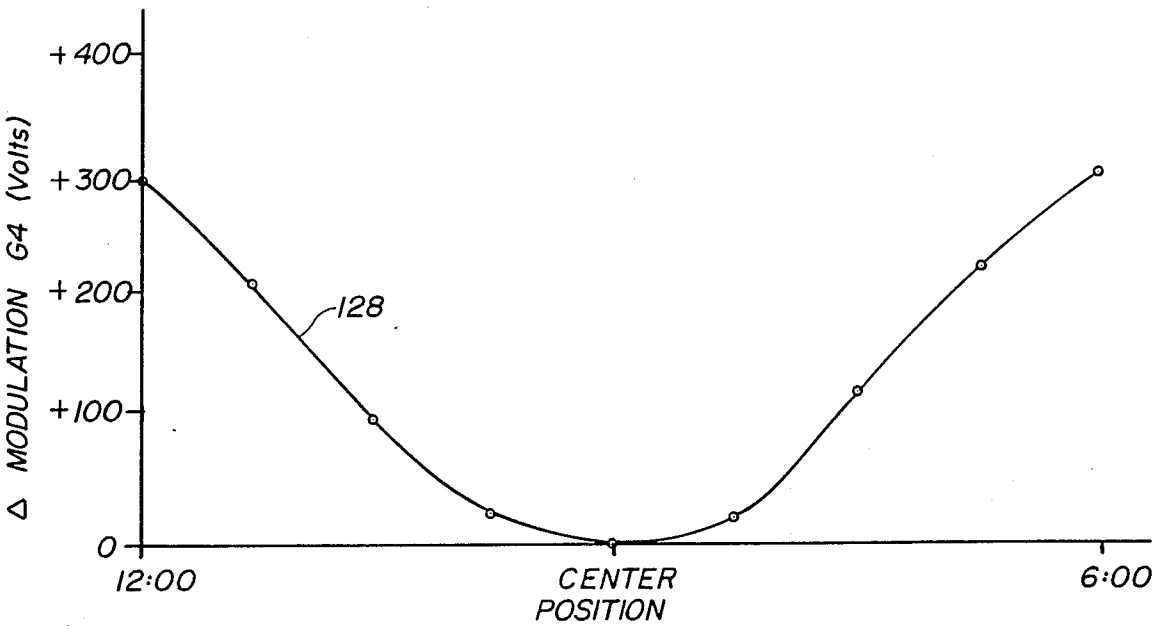
FIG. 14 shows a curve which represents the vertical rate modulation voltage that must be superimposed on the low focus voltage applied to the G4 electrode to focus the electron beams along on the minor axis of the tube.

It is seen in FIG. 13 that a disadvantage of the dual electrode dynamic modulation signal voltages suggested by the waveforms of FIGS. 13 and 14 is that the horizontal rate modulation voltage signal required to properly focus electron beams along the top of the screen and in the 2D and 10D corners (curve 126) is greater than that required for proper electron beam focus along the major axis from 3D to 9D (curve 124). In other words, simultaneous focus along the major/minor axes and in the corner locations cannot be achieved completely with horizontal rate modulation of the G5' main lens electrode 54 and vertical rate modulation of the G4 electrode 50. While adequate, the "simple" dual electrode dynamic modulation described above, does not maximize the performance of the system.

Figure 15:
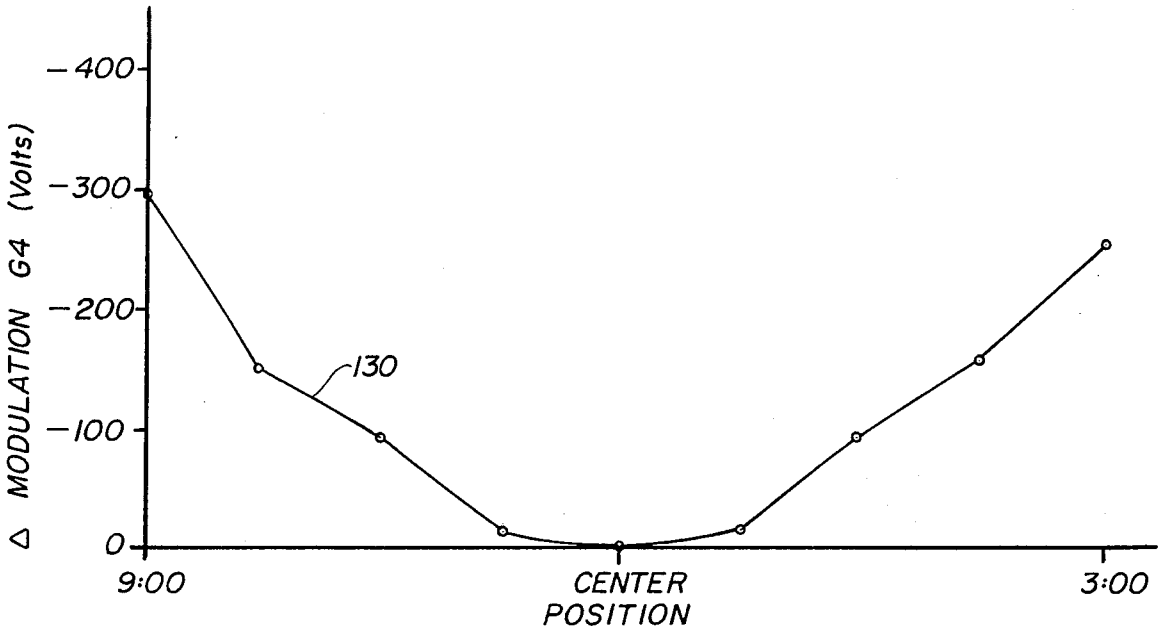
FIG. 15 shows a curve which represents a second horizontal rate modulation voltage that must be superimposed on the low focus voltage applied to the G4 electrode to apply an additional focus correction factor to the deflected electron beams.

System performance is maximized by introducing a "compound" dual grid modulation which forces the total horizontal rate modulation voltages along the major axis (3D-9D) and in the corners (2D-10D) to be the same. This can be accomplished by applying an additional horizontal rate modulation voltage signal to the G4 modulation electrode 50 because, while the G4 electrode 50 is effective for horizontal rate modulation at the 3D and 9D screen locations, it has no effect on the 2D and 10D corners. Thus, by applying a second horizontal rate modultion voltage signal 130 ranging from 0 to −300 volts (relative to G2) to the G4 electrode 50 to overfocus the electron beam at the 3D and 9d locations, the amplitude of the first horizontal rate modulation voltage signal applied to the G5' electrode 54 can be increased to the values shown in curve 126 to focus the corners 2D and 10D while retaining the focus along the major axis at 3D and 9D. the second horizontal modulation rate voltage signal 130 is shown in FIG. 15.

Figure 16:
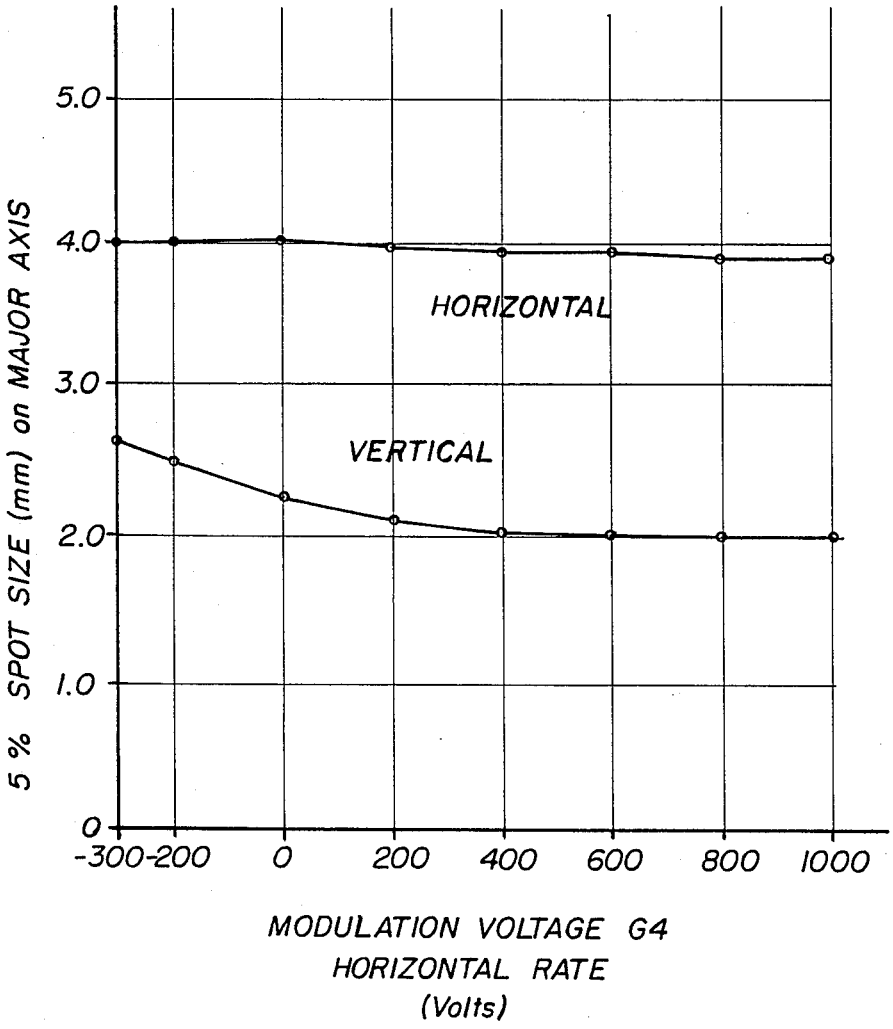
FIG. 16 shows a pair of curves which relate the electron beam spot size on the screen, along the major tube axis at the 3D and 9D positions, as a function of the horizontal rate modulation voltage applied to the G4 electrode.
Figure 17:
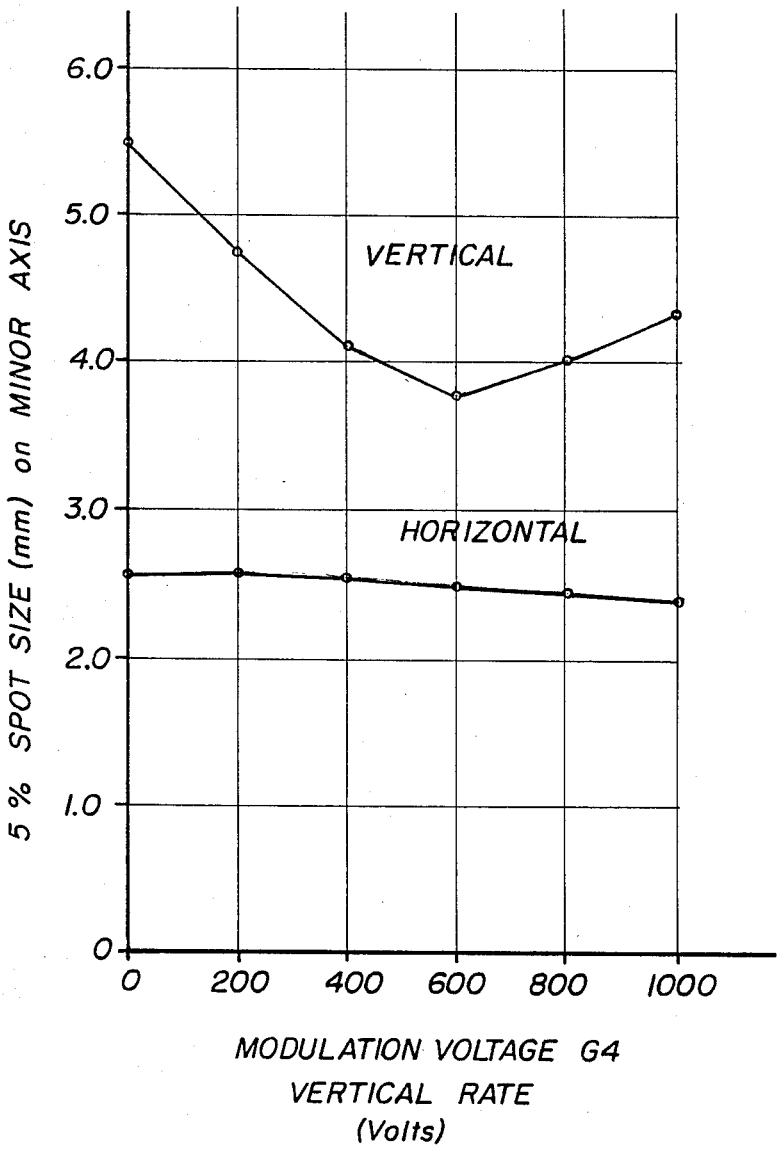
FIG. 17 shows a pair of curves which relate the electron beam spot size, on the screen, along the minor tube axis at the 6D and 12D positions as a function of the vertical rate modulation voltage applied to the G4 electrode.

FIGS. 16 and 17, respectively, show the effect of horizontal rate and vertical rate modulation voltage signals, applied to the G4 electrode 50, on beam spot size along the major axis at 3D-9D and the minor axis at 6D-12D. FIG. 16 shows that along the major axis the electron beam spot size on the screen is horizontally elongated by about 1.6:1 at the desired operating point of about 300 volts below the G2 potential of 350 V. FIG. 17 shows that along the minor axis at the 6D and 12D positions the electron beam spot size on the screen is vertically elongated by about 1.7:1 at the desired operating point of about 300 volts above G2 potential. The modulation described above affects the vertical spot size without substantially effecting the horizontal spot size.

CONCLUSION

The inproved electron gun 40 comprises three lenses the second and third of which can be separately modulated to correct astigmatism introduced into the electron gun from a self-converging yoke surrounding the tube in the junction of the funnel and the neck of the tube envelope. The third lens includes a G5' electrode that can be modulated by a first voltage signal at the horizontal scan rate to provide a focusing correction of the electron beams on the screen along the direction of the major tube axis. A second voltage signal at the vertical scan rate can be applied to the G4 electrode of the second lens to provide a focusing correction of the electron beams on the screen along the direction of the minor tube axis. By utilizing a compound dual modulation technique including, in addition to the above described modulation voltages, an additional horizontal rate modulation voltage signal applied to the G4 electrode, and by increasing the horizontal rate modulation voltage applied to the G5' electrode, the electron beams can be focused in the corners in addition to being optimized along the major and minor axes.

While the present embodiment is described with respect to a 27V110 tube, the invention is not limited to that size tube and may be utilized in larger or smaller tubes.

What is claimed is:

1. In a color display system including a cathode-ray tube having an envelope with an inline electron gun therein for generating and directing three inline electron beams along initially coplanar paths towards a screen on an interior surface portion of said envelope, said gun including a plurality of spaced electrodes which provide a first lens, a second lens and a third lens for focusing said electron beams, said first lens including a beam-forming region for providing substantially symmetrical beams to said second lens, said system including a magnetic deflection yoke that produces an astigmatic magnetic deflection field, the improvement comprising means for applying at least a first dynamic voltage signal to a first modulation electrode of said second lens electrodes, and means for simultaneously applying a second dynamic voltage signal to a second modulation electrode of said third lens, said second modulation electrode being electrically separate from said first modulation electrode, said first and second signals being related to deflection of the electron beams.

2. The display system as described in claim 1, further including means for applying a third dynamic voltage signal to said first modulation electrode of said second lens, said third voltage signal being related to deflection of the electron beams.

3. In a color display system including a cathode-ray tube having an envelope with an inline electron gun therein for generating and directing three inline electron beams along initially coplanar paths towards a screen on an interior portion of said envelope, said gun including a plurality of spaced electrodes which provide a first lens, a second lens and a third lens for focusing said electron beams, said first lens including a beam-forming region for providing substantially symmetrical beams to said second lens and, said second lens including three electrodes, one of which being a first modulation electrode disposed between the two other electrodes of said second lens, said system including a self-converging yoke that produces an astigmatic field, the improvement comprising said second lens including means for applying a first vertical rate modulation voltage signal to a said first modulation electrode thereof, and asymmetric beam-focusing means for providing asymmetrically-shaped beams to said third lens, and said third lens including means for applying a first horizontal rate modulation voltage signal to a second modulation electrode thereof, said first vertical and horizontal rate modulation signals being related to deflection of the electron beams.

4. The display system as described in claim 3, further including means for applying a second horizontal rate modulation voltage signal to said first modulation electrode of said second lens, said second horizontal rate modulation voltage signal also being related to deflection of the electron beams.

5. In a color display system including a cathode-ray tube having an envelope with an inline electron gun therein for generating and directing three inline electron beams along initially coplanar electron beam paths toward a screen on an interior portion of said envelope, said gun including a plurality of spaced electrodes which provide a first lens, a second lens and a third lens for focusing said electron beams, said first lens including a beam-forming region for providing substantially symmetrical beams to said second lens, said second lens including rotationally asymmetrical beam-focusing means for providing asymmetrically-shaped beams to said third lens, said third lens being a low aberration main focusing lens, and a self converging yoke that produces an astigmatic magnetic deflection field, wherein the improvement comprises said rotationally asymmetrical beam-focusing means of said second lens includes a first modulation electrode with three rotationally asymmetrical inline openings therethrough, each of said openings being elongated in the direction of the inline openings, each of said openings including a substantially circular center portion and two oppositely disposed arcuate portions intersecting the circumference of said circular center portion, and means for applying a first vertical rate modulation voltage signal to said electrode of said second lens, and said third lens including means for applying a first horizontal rate modulation voltage signal to a second modulation electrode thereof, said first vertical and horizontal rate modulation signals being related to deflection of the electron beams.

6. The display system as described in claim 5, further including means for applying a second horizontal rate modulation voltage signal to said first modulation electrode of said second lens, said second horizontal rate modulation voltage signal also being related to deflection of the electron beam.

7. In a color cathode-ray tube including an envelope having therein an inline electron gun for generating and directing three inline electron beams along initially coplanar electron beam paths towards a screen on an interior portion of said envelope, said gun including a plurality of spaced electrodes which provide a first lens, a second lens and a third lens for focusing said electron beams, said first lens including a beam-forming region for providing substantially symmetrical beams to said second lens, said second lens including rotationally asymmetrical beam-focusing means for providing asymmetrically-shaped beams to said third lens, and said third lens being a low aberration main focusing lens, wherein the improvement comprises said rotationally asymmetrical beam-focusing means of said second lens including a first modulation electrode with three rotationally asymmetrical inline opening therethrough, each of said openings being elongated in the direction of the inline openings, each of said openings including a substantially circular center portion and two oppositely disposed arcuate portions intersecting the circumference of said circular center portion.

8. The tube as described in claim 7, wherein each of said openings in said first modulation electrode comprising a primary opening having a first radius and two secondary circular openings partially overlying said primary opening, said secondary openings each having a second radius which is less than said first radius.

9. The tube as described in claim 7, wherein a multipole lens is disposed between said second lens and said third lens in each of the electron beam paths, wherein said electrodes for forming said multipole lens includes a first multipole lens electrode and a second multipole lens electrode, said first multipole lens electrode comprising a portion of said second lens and said second multipole lens electrode comprising a portion of said third lens.

10. In a color display system including a cathode-ray tube having an envelope with an inline electron gun therein for generating and directing three inline electron beams along initially coplanar paths towards a screen on an interior surface of said envelope, said gun including a plurality of spaced electrodes which provide a first lens, a second lens and a third lens for focusing said electron beams, said first lens including a beam-forming region for providing substantially symmetrical beams to said second lens, said second lens including three electrodes, one of which being a first modulation electrode, and said system including a magnetic deflection yoke that produces an astigmatic magnetic deflection field, the improvement comprising means for applying at least a first dynamic voltage signal to said first modulation electrode of said second lens electrodes, and means for simultaneous applying a second dynamic voltage signal to a second modulation electrode of said third lens, said second modulation electrode being electrically separate from said first modulation electrode, said first and second signals being related to deflection of the electron beams.

11. The display system as described in claim 10, further including means for applying a third dynamic voltage signal to said first modulation electrode of said second lens, said third voltage signal being related to deflection of the electron beams.

12. In a color display system including a cathode-ray tube having an envelope with an inline electron gun therein for generating and directing three inline electron beams along initially coplanar paths towards a screen on an interior portion of said envelope, said gun including a plurality of spaced electrodes which provide a first lens, a second lens and a third lens for focusing said electron beams, said first lens including a beam-forming region for providing substantially symmetrical beams to said second lens, said second lens including three electrodes, one of which being a first modulation electrode disposed between the other two electrodes of said second lens, said system including a self-converging yoke that produces an astigmatic magnetic field, the improvement comprising said second lens including means for applying a first vertical rate modulation voltage signal to a first modulation electrode thereof, and asymmetric beam-focusing means for providing asymmetrically-shaped beams to said third lens, and said third lens including means for applying a first horizontal rate modulation voltage signal to a second modulation electrode thereof, said second modulation electrode being electrically separate from said first modulation electrode, said first vertical and horizontal rate modulation signals being related to deflection of the electron beams.

13. The display system as described in claim 12, further including means for applying a second horizontal rate modulation voltage signal to said first modulation electrode of said second lens, said second horizontal rate modulation voltage signal also being related to deflection of the electron beams.

* * * * *

UNITED STATES PATENT AND TRADEMARK OFFICE
CERTIFICATE OF CORRECTION

PATENT NO. : 4,877,998

DATED : Oct. 31, 1989

INVENTOR(S) : Loren L. Maninger et al.

It is certified that error appears in the above-identified patent and that said Letters Patent is hereby corrected as shown below:

Col. 5, line 65, change
"the" to --The--.

Col. 6, line 53, change
"each" to --Each--.

Col. 6, line 61, change
"0.511" to --0.508--.

Col. 6, line 62, change
"2.301" to --1.702--.

Col. 6, line 68, change
"4,013" to --4.013--.

Col. 8, line 40, change
"Typcially" to --Typically--.

UNITED STATES PATENT AND TRADEMARK OFFICE
CERTIFICATE OF CORRECTION

PATENT NO. : 4,877,998

DATED : Oct. 31, 1989

INVENTOR(S) : Loren L. Maninger et al.

It is certified that error appears in the above-identified patent and that said Letters Patent is hereby corrected as shown below:

Col. 10, line 7, change
"9d" to --9D--.

Col. 10, line 12, change
"the" to --The--.

Signed and Sealed this

Twenty-fifth Day of December, 1990

*Attest:*

HARRY F. MANBECK, JR.

*Attesting Officer*

*Commissioner of Patents and Trademarks*